United States Patent [19]

Piesczek

[11] Patent Number: 4,602,475

[45] Date of Patent: Jul. 29, 1986

[54] REDUCED TENSION AUTOMATIC YARN SAMPLER

[75] Inventor: Wolfgang A. Piesczek, Inman, S.C.

[73] Assignee: American Hoechst Corp., Somerville, N.J.

[21] Appl. No.: 540,747

[22] Filed: Oct. 11, 1983

[51] Int. Cl.[4] ..... D01H 15/00; B65H 69/06

[52] U.S. Cl. ..... 57/22

[58] Field of Search ..... 57/22, 261

[56] References Cited

U.S. PATENT DOCUMENTS

| | | | |
|---|---|---|---|
| 3,411,548 | 11/1968 | Pfarrwaller | 139/122 |
| 3,474,615 | 10/1969 | Irwin et al. | 57/142 |
| 3,487,618 | 1/1970 | Arguelles | 57/22 |
| 3,599,886 | 8/1971 | Koller | 242/35.5 R |
| 3,732,678 | 5/1973 | Berry, Jr. | 57/22 |
| 3,751,981 | 8/1973 | Jernigan et al. | 73/160 |
| 3,776,480 | 12/1973 | Lawson | 242/47.01 |
| 3,796,032 | 3/1974 | Clontz | 57/22 |
| 3,844,504 | 10/1974 | Lawson | 242/47.01 |
| 3,867,810 | 2/1975 | Meertens et al. | 57/142 |
| 3,926,381 | 12/1975 | Lawson et al. | 242/47.01 |
| 3,939,671 | 2/1976 | Lawson et al. | 66/86 R |
| 3,949,946 | 4/1976 | Rohner et al. | 242/35.5 R |
| 4,121,409 | 10/1978 | Uchida et al. | 57/22 |
| 4,263,775 | 4/1981 | Mima | 57/22 |
| 4,385,507 | 5/1983 | Sawazaki | 66/140 R |
| 4,397,137 | 8/1983 | Davies et al. | 57/22 |
| 4,397,138 | 8/1983 | Rohner et al. | 57/22 |
| 4,397,139 | 8/1983 | Wey et al. | 57/22 |
| 4,397,140 | 8/1983 | Sheehan et al. | 57/22 |
| 4,407,117 | 10/1983 | Garnsworthy | 57/22 |
| 4,411,128 | 10/1983 | Mima | 57/22 |
| 4,419,858 | 12/1983 | Rohner et al. | 57/22 |
| 4,419,859 | 12/1983 | Mima | 57/22 |
| 4,423,586 | 1/1984 | Matsui | 57/22 |
| 4,424,663 | 1/1984 | Rohner et al. | 57/22 |
| 4,433,534 | 2/1984 | Mima | 57/22 |
| 4,444,132 | 4/1984 | Breitenbach | 112/79 R |
| 4,445,317 | 5/1984 | Mima | 57/22 |
| 4,445,318 | 5/1984 | Becker et al. | 57/22 |

*Primary Examiner*—Donald Watkins

[57] ABSTRACT

An improved, reduced tension, automatic yarn sampling device, and a process for its use, is disclosed. The device exerts significantly lower tension on multifilament yarn thread than that tension typically required to approach the deformation yield point of partially oriented yarn.

13 Claims, 6 Drawing Figures

AUTOMATIC YARN SAMPLER;
PNEUMATIC CONTROL SYSTEM

REDUCED TENSION AUTOMATIC YARN SAMPLER

BACKGROUND OF THE INVENTION

This invention relates to automatic yarn sampling devices. More particularly, this invention relates to an automatic yarn sampling device which is operable up to yarn processing speeds of at least 1000 meters/minute and which exerts significantly less tension on the yarn than that tension typically required to approach the deformation yield point of partially oriented yarn.

In addition to fully drawn yarn, fiber manufacturers often manufacture multifilament yarn which is partially, rather than fully, oriented before being wound upon a spool. A process for manufacturing partially oriented yarn is described in D. Petrille, "Drawing And Bulking Polyester Yarns," U.S. Pat. No. 3,771,307 (Nov. 13, 1973).

It is usually desirable to sample spools of multifilament yarn to test various properties for quality control purposes before the yarn is subjected to further processing. Accurate measurement of the degree of orientation is a particularly important quality control check for partially oriented multifilament yarn.

For some time there has been a need in the industry for an automatic yarn sampler which would not exert significant tension or stress on the yarn to be sampled. Various types of automatic yarn samplers have been developed by prior artisans, which utilize automatic knotters and air splicers, but these devices either cannot operate at normal yarn testing speeds or subject the yarn being sampled to tension in excess of the typical yarn deformation tension range of partially oriented yarn. This tension exerted on partially oriented multifilament yarn during the sampling process prior to measurement virtually precludes accurate measurement of many yarn properties, since the sampling tension causes permanent deformation of the yarn sample.

SUMMARY OF THE INVENTION

The invention is an automatic multifilament sampling device which does not exert significant stress or tension on the multifilament yarn to be sampled comprising:

(a) means for guiding the position of travel of a moving first yarn thread;

(b) means for holding a stationary second yarn thread and for advancing said second yarn thread into close axial proximity with said first yarn thread within said guide means;

(c) means positioned proximate said guide means for intermeshing said second yarn thread with said first yarn thread;

(d) first yarn cutting means positioned proximate said guide means and on the downstream side of said intermeshing means for severing said stationary second yarn thread from said holding and advancing means;

(e) second yarn cutting means positioned proximate said guide means and on the upstream side of said intermeshing means for severing said moving first yarn thread;

(f) means for coordinating the sequential operation of said holding and advancing means, said first cutting means, said intermeshing means and said second cutting means such that stationary second yarn thread is severed from said holding and advancing means and brought into motion as the result of intertwining with said moving first yarn thread, and such that said moving first yarn thread is subsequently severed.

DETAILED DESCRIPTION OF THE INVENTION

Figure 1:
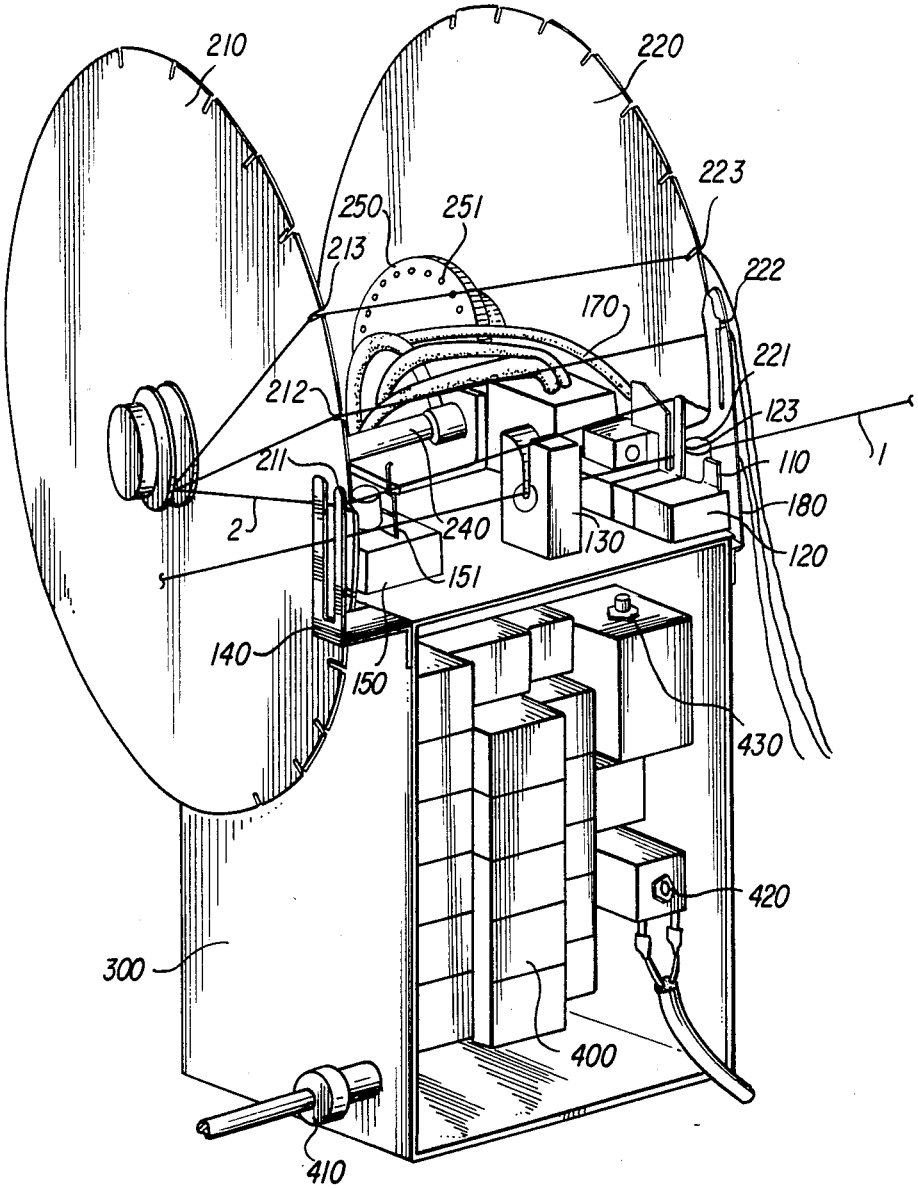
FIG. 1 is an isometric view of a specific embodiment of the invention, looking from the left side, depicting a first yarn thread running through the apparatus and a plurality of yarn threads laced in the feeder wheels awaiting sequential presentation and sampling.

As summarized above, the present invention is an automatic yarn sampling device which does not exert significant stress or tension on the multifilament yarn thread to be sampled, even at high yarn speeds. It should be noted that the invention does not itself test the multifilament yarn threads in any manner whatsoever; the sole function of the present invention is to change multifilament yarn thread samples without exerting any significant stress or tension on the multifilament yarn threads.

The present invention may best be illustrated by a specific embodiment of the invention depicted in FIGS. 1 through 6. The device shown in FIG. 1 comprises three systems: The multifilament yarn thread transfer system (100) and the feeder system (200) are both mounted on top of housing (300) which contains the pneumatic control system (400).

Figure 2:
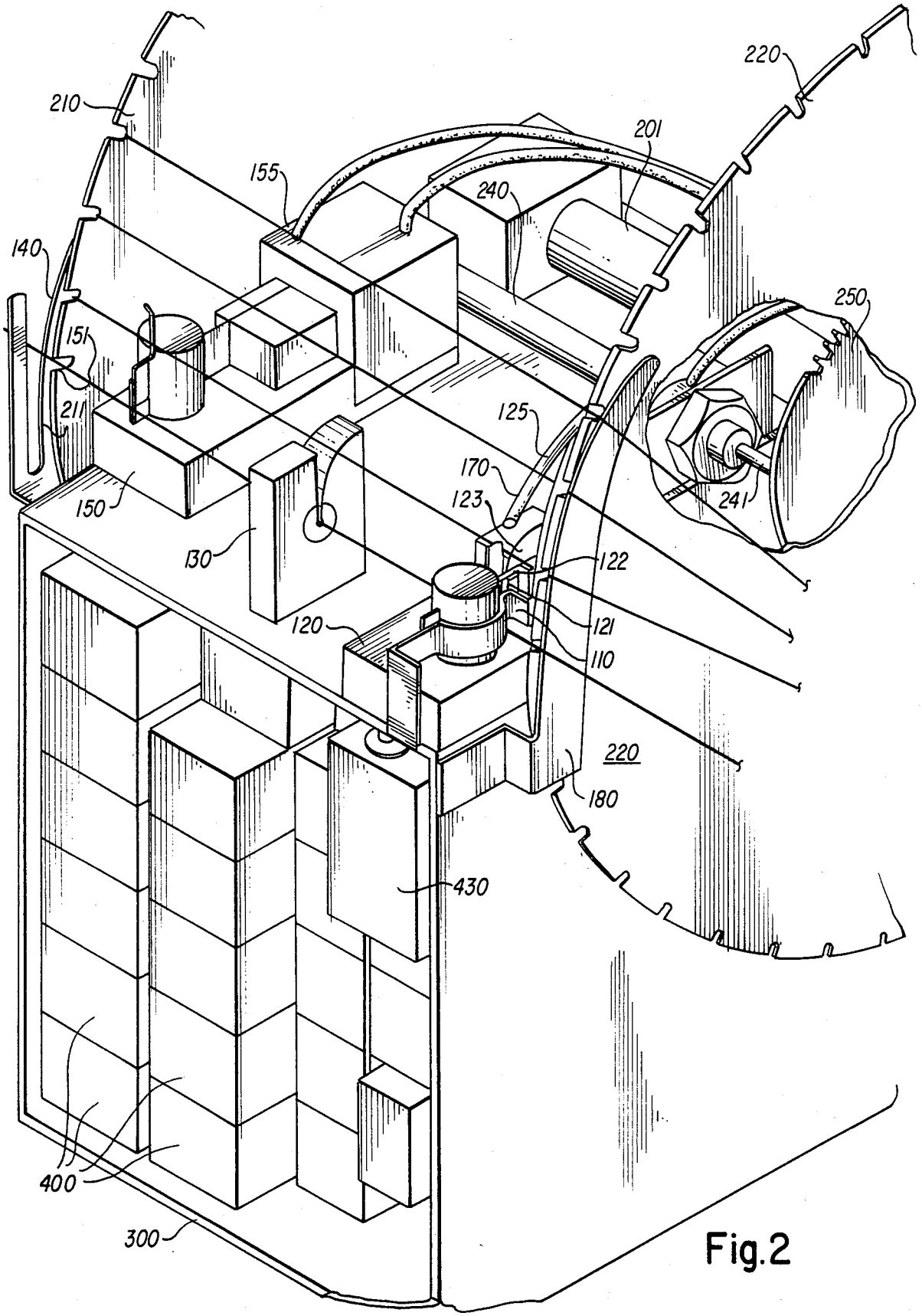
FIG. 2 is an isometric view of the specific embodiment of the invention illustrated by FIG. 1, looking from the right side.

In the starting position depicted in FIGS. 1 and 2, multifilament yarn thread 1 (1) taken from a spool of multifilament yarn thread (not shown) enters the multifilament yarn thread transfer system underneath the bar guide (110), passing through the yarn cutter (120), the entanglement jet (130) and exiting at the slot guide (140) all of which elements comprise the moving yarn guide means, to a testing apparatus (not shown). At this stage the device serves only as a low tension guide system for multifilament yarn thread 1; with proper alignment the frictional effect of the guiding elements (110), (120), (130) and (140) is sufficiently low to prevent any permanent multifilament yarn thread deformation in the device during processing of the yarn. Multifilament yarn 2 (2) and subsequent multifilament yarn samples are laced up in successive matched pairs of notches (211)–(221), (212–222), etc. of the two wheels (210) and (220) of the feeder (200) and fastened in clamp (230). The feeder wheels are rotably mounted to sequentially advance a plurality of stationary yarns (2), and are positioned as shown in FIGS. 1 and 2; the vacant notches adjacent to multifilament yarn thread 2 are lined up with the top of the housing (300). In this position the upper extension of bar guide (110) holds multifilament yarn thread 2 still securely in the notch (221) of the feeder wheel (220).

At the start of the multifilament yarn transfer cycle, the feeder wheels (210) and (220), which are mounted on the same axis (201), are simultaneously rotated by one notch so that notches (211) and (221) now line up with the top of housing (300). This rotation advances multifilament yarn thread (2) out of notch (221) into the yarn transfer position and the adjacent multifilament yarn thread (3) into the starting position of multifilament yarn thread 2. In similar fashion, all of the multifilament yarn threads (3) (4) and (5) have been advanced one position by the rotation of feeder wheels (210) and (220).

Figure 3:
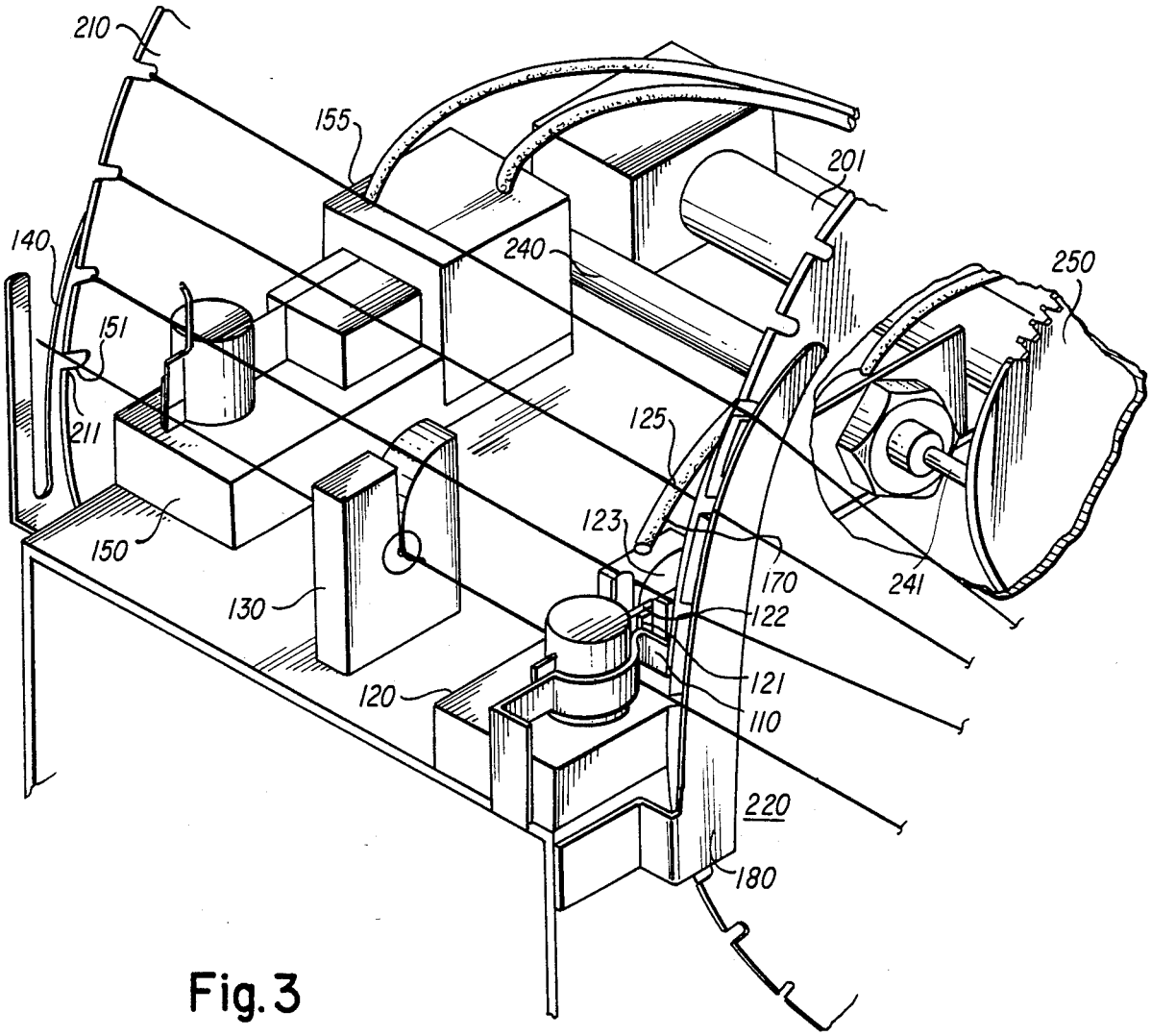
FIG. 3 illustrates the take-up position of the device prior to sampling yarn thread 2.

FIG. 3 illustrates multifilament yarn thread (2) in the transfer position; multifilament yarn thread (2) is inserted into the cutting slot (151) of the second yarn cutter (150), the yarn entanglement jet (130) and the cutter guide (123); with multifilament yarn thread (2) under the bar guide (110) and resting on the blade bar (122) above the yarn cutting slot (121).

Figure 4:
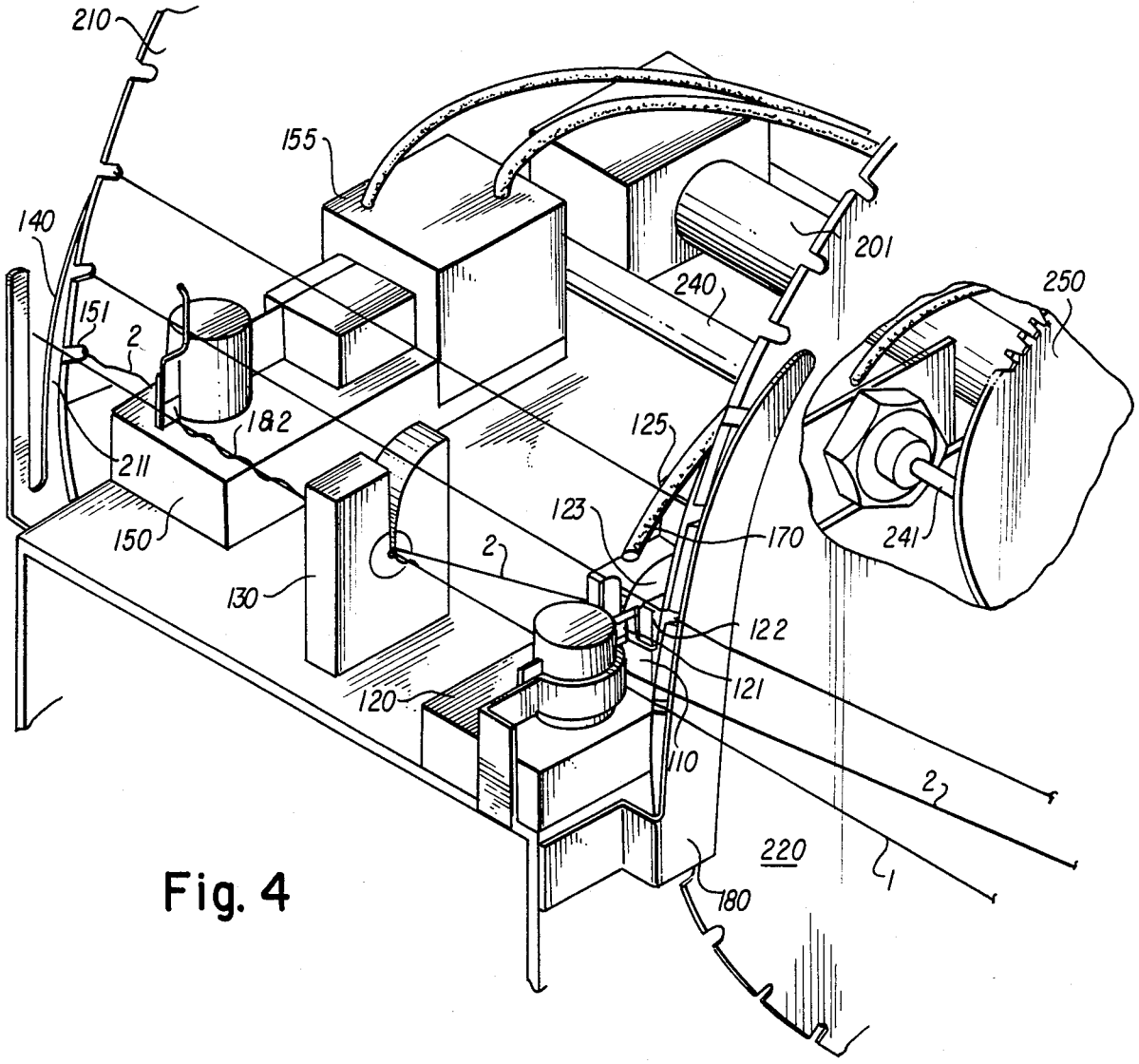
FIG. 4 illustrates the first stage of the multifilament yarn thread sampling operation, depicting the first severing operation and entanglement of two multifilament threads.
Figure 5:
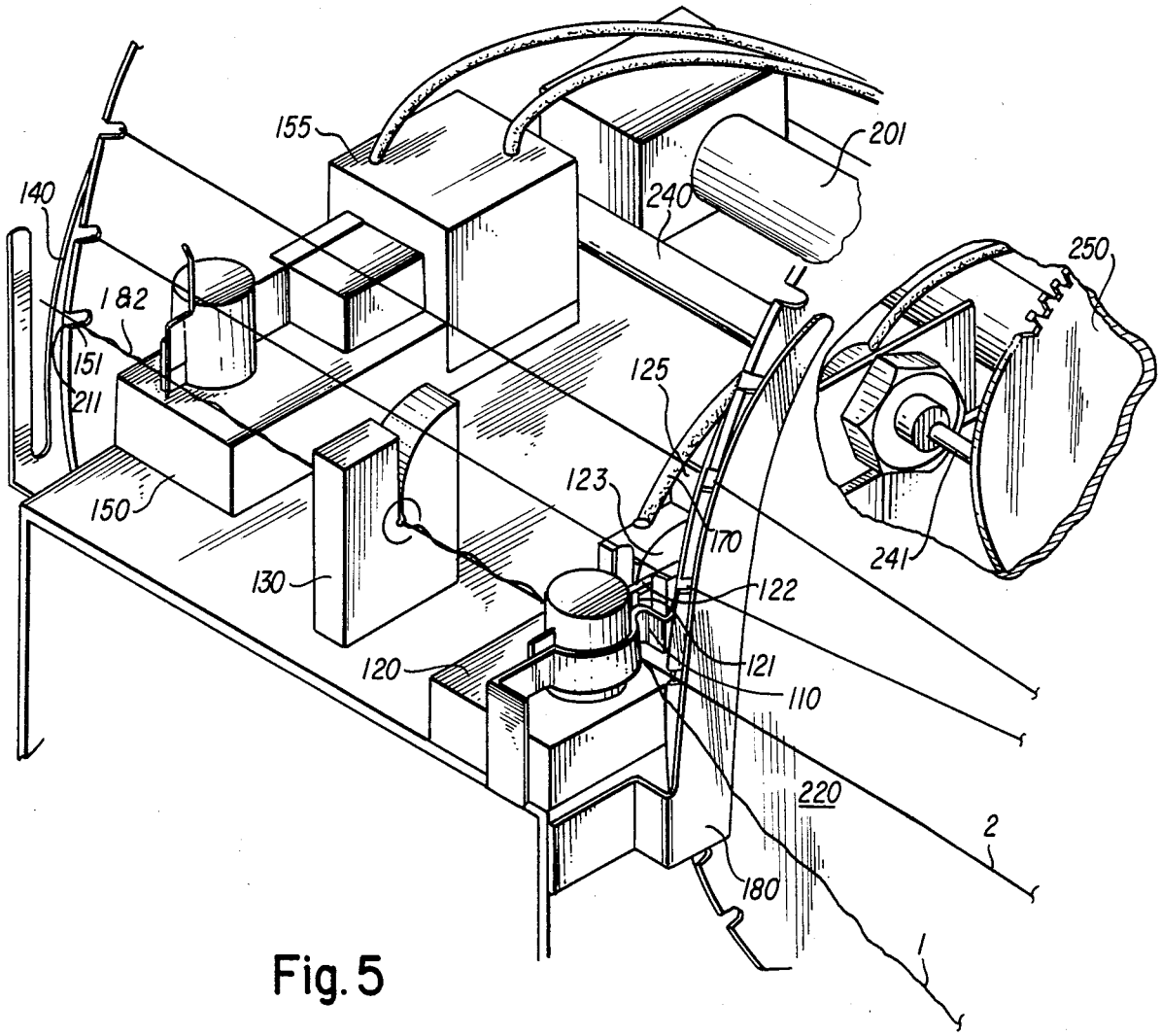
FIG. 5 illustrates the second stage of the multifilament yarn thread sampling operation, depicting the second thread severing operation.

The operation of the present invention can be divided into stages, which are illustrated sequentially by FIGS. 4 and 5. In the first stage, illustrated in FIG. 4, multifilament yarn thread (2) is severed by activation of yarn cutter (150) thereby cutting multifilament yarn thread 2 near the inner side of the feeder wheel (210); simultaneously or shortly thereafter, an air pulse released through entanglement jet (130) intermeshes multifilament yarn threads 1 and 2, thereby accelerating multifilament yarn thread 2 from rest to the yarn processing speed. At the end of stage 1, multifilament yarn thread 2 moves together, but not joined, with multifilament yarn thread 1 along the same path through the yarn sampling device with the exception that multifilament yarn thread 1 is passing through cutting slot of cutter blade (121) of yarn cutter (120) while multifilament yarn thread 2 is crossing over blade bar (122) of yarn cutter (120).

In the second stage, illutrated by FIG. 5, multifilament yarn thread 1 is removed from the yarn path by activation of yarn cutter (120). The outward cutting motion of the cutter blade (120) and an air pulse simultaneously released from the end of air hose (170) eject severed multifilament yarn thread 1 outwardly downward, thereby avoiding re-entanglement of the two moving multifilament yarn threads.

As cutter blade (121) reaches its most extreme cutting position, the end of blade bar (122) clears the slot of cutter guide (123) thereby permitting multifilament yarn thread 2 to drop onto the top of cutter blade (121). Multifilament yarn thread 2 will slide into the cutting slot as cutter blade (121) retracts, thereby completing the multifilament yarn thread transfer cycle.

Yarn guide (180) prevents the moving multifilament yarn from being caught in the slots of the feeder wheel (220), especially during the rotation of the wheel. The guide bar (110) holds multifilament yarn thread 1 down in the cutting slot of cutter blade (121) after insertion to assure the proper cutting of the multifilament yarn thread during the transfer cycle.

Figure 6:
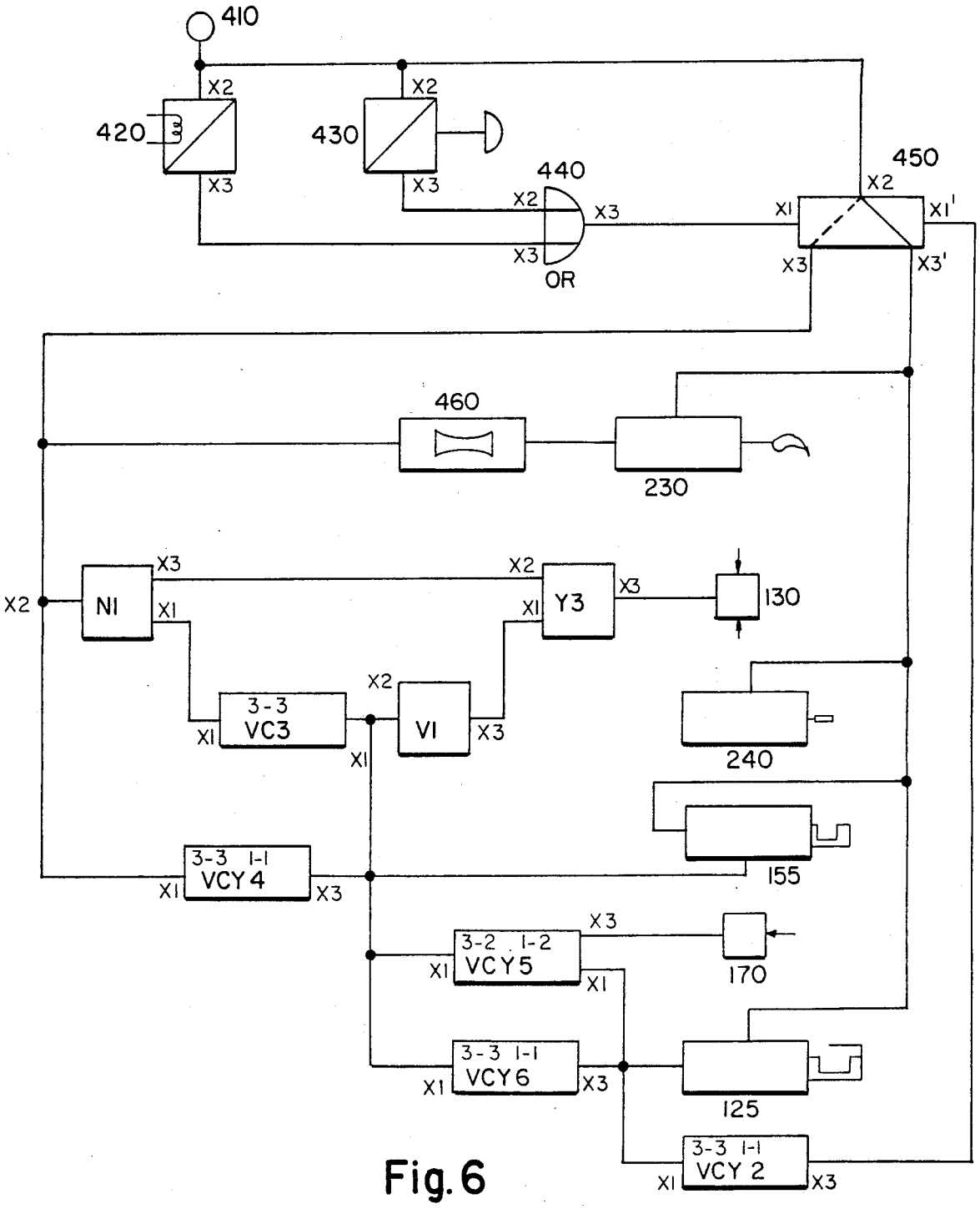
FIG. 6 is a schematic diagram illustrating the pneumatic control system employed by the present invention.

The discussion of the pneumatic control system (400) will reveal further details of the invention. FIG. 6 shows one possible selection of pneumatic elements to control the various functions of the device during the transfer cycle in the desired sequence.

Referring to FIG. 6, in the rest position pressurized air is supplied to the main port (410) passes through ports X2 and X3′ of the flip-flop element (450) and enters air cylinders (230), (240), (155) and (125). The pistons of cylinders (125), (230) and (240) are retracted and the piston of cylinder (155) is extended.

The transfer cycle is started by an air signal from the start switch (420) (electric pneumatic switch) or (430) (manual pneumatic switch) to port X1 of flip-flop element (450). This changes the continuous air output from port X3′ to X3. The piston (241) of the single action cylinder (240) is pushed out by a built-in return spring and is resting on the side wall of the ratchet wheel (250) in between two index holes (251). The air passes through the orifice (460) to an air cylinder (230) (shown schematically in FIG. 6). Its piston, with a pawl mounted on its end, functions as reciprocating lever and turns the ratchet wheel until the piston (241) of cylinder (240) engages in the next index hole. Since the ratchet wheel (250) and the two feeder wheels (210), (220) are mounted on a common axis (201), the combined actions of the air cylinders (230) and (240) control the start/stop motion of the feeder (200). Engagement of piston (241) in the same index hole is prevented by a flexible mount of cylinder (240) which causes it to pivot around an axis parallel to a radius vector of the ratchet wheel (250).

Air also passes through the not element N1 to port X2 of the yes element Y3 and starts the adjustable timer VCY4. This timer controls the delay between step 1 and step 2 of the transfer cycle and assures proper insertion of multifilament yarn thread 2 into the yarn transfer position.

After the preset time, air is released at port X3 of timer VCY4 and passes to cylinder (155) of the yarn cutter (150), to the pulse generator VCY5 and the timer VCY6. The air also passes through valve V1 (optional) to port X1 of the yes element Y3.

The passage from port X2 to X3 of the yes element is opened and an air pulse released through the entanglement jet (130). The length of the pulse can be adjusted with the timer VC3, which delays the air signal to port X1 of the not element N1. When the air signal interrupts the output on port X3 of element N1 the second step of the transfer cycle is completed.

The next step of the transfer cycle is initiated when the adjustable timer VCY6 outputs air to cylinder (125) of the yarn cutter (120) and to port X1 of the pulse generator VCY5 and starts timer VCY2. The air pulse released at port X3 of VCY5 exits at the orifice 170 and ejects the severed end of multiflament yarn thread 1.

The output of air by the adjustable timer VCY2 resets the flip-flop (450) with an air signal on port X1′. The continuous air output is shifted from port X3 back to port X3′ and the initial state of the system is restored.

The cutter blade (150) is preferably a horizontally mounted retractable blade adapted to slidingly intercept the axial position of stationary yarn thread 2, thereby cutting same. Cutter blade (120) is a similar arrangement adapted to intercept the path of travel of moving yarn thread 1, thereby cutting same.

Intermeshing comprises a housing having a V shaped cut on an upper surface, permitting the entrance of stationary yarn 2 as it is advanced into close axial proximity to moving yarn 1 as it passes through the chamber. The chamber consists of a cylindrical hollowed out portion of the housing having openings on the side to permit the passage of yarn therethrough, and to receive yarn 2. At least one orifice is located in the intermeshing chamber, through which air is forced as a pulse of adjustable duration, thereby causing intermeshing of the filaments of the respective yarn threads together during operation of said chamber.

The above description as one embodiment of the present invention is illustrative only; the scope of the present invention is limited only by the appended claims.

The advantage of the present invention is most pronounced when testing the low denier, low tenacity multifilament yarns which are most susceptible to permanent deformation. As denier and overall tenacity of the multifilament increases, the multifilament thread is better able to withstand tension exerted upon it by conventional yarn sampling equipment without suffering permanent deformation. While this particular advantage of the present invention in comparison to conventional yarn sampling equipment decreases with increasing multifilament denier and overall tenacity, the present invention is, of course, operable with the larger denier multifilament yarns. The practical limit with regard to multifilament denier is that denier which imparts sufficient stiffness to the multifilament to significantly affect the entanglement operation.

EXAMPLES

The following Examples illustrate the practice and advantages of the invention. As Examples, they are illustrative only and are not intended to limit the scope of protection afforded by the claims in any way.

EXAMPLE I

Several spools of 118 denier partially oriented polyethylene terephthalate multifilament yarn having a circular filament cross-section and composed of 32 individual filaments per thread were tested for draw tension using a Dynafil draw tension tester manufactured by Textechno Herbert Stein GmbH & Co. KG. The test samples were fed to the Dynafil from an automatic knotter/storage feeder. The Dynafil draw tension tester was used in this Example to measure the tension of the yarn tested to further elongation at elevated temperatures. The Dynafil test procedure is to pass the test yarn around a first rotating godet, through an oven which raises the temperature of the test yarn to a hot drawing temperature, and around a second godet running at a faster circumferential speed than the first godet. The difference in the effective speeds of the godets determines the amount of tension exerted on the test yarn. The amount of tension exhibited by the test yarn indicates the degree of orientation of the yarn. In general, the more tension a test yarn exhibits, the higher its orientation.

The same spools of 118 denier partially oriented polyethylene terephthalate multifilament yarn were then tested on the same Dynafil draw tension tester under the same test conditions with the sole exception that the test samples were taken from the yarn spools using the reduced tension automatic yarn sampler described above.

The test conditions and results for Example I are listed in Table I below.

EXAMPLE II

Using the test procedure employed in Example I above, several spools of 261 denier partially oriented polyethylene terephthalate multifilament yarn, having a circular cross-section and composed of a 32 individual filaments per thread were tested for draw tension on the Dynafil draw tension tester. Again, all conditions were identical except for substitution of the reduced tension automatic yarn sampler of the present invention for the automatic knitter/storage feeder of the prior art. The test conditions and results for Example II are listed in Table II below.

EXAMPLE III

This Example illustrates the ability of the present invention to operate at yarn processing speeds of up to 1,097 meters/minute without imparting permanent deformation to multifilament yarn.

Because the Dynafil draw tension tester cannot operate at yarn processing speeds above approximately 500 meters per minute, the following test procedure was employed.

118 denier partially oriented polyethylene terephthalate multifilament yarn samples were randomly selected from several, but not all, of the same spools employed in Example I through the reduced tension automatic yarn sampler described above, and wound on a test spool at a yarn processing speed of 1,097 meters/minute. The sample spool was then directly fed to the Dynefil draw tension tester at 150 meters/minute.

Using the same test conditions, yarn samples from the same spools of 118 denier partially oriented polyethylene terephthalate multifilament yarn were tested for draw tension using the Dynafil draw tension tester at 150 meters per minute. The thread samples were directly fed to the Dynafil draw tension tester without any automatic sampling apparatus being used. Tests results for Example III are listed in Table III below.

TABLE I

| Sample Changer | Yarn Sample Length (m) | Heater Temp. (°C.) | Yarn Take-Up Speed (m/min) | Draw Ratio | Draw Ten. (cN/tex) | Std. Dev. |
|---|---|---|---|---|---|---|
| Conventional Automatic Knotter/Storage Feeder | 25 | 200 | 150 | 1.7 | 4.0 | 0.1301 |
| Reduced Tension Automatic Yarn Sampler | 25 | 200 | 150 | 1.7 | 3.7 | 0.0444 |

TABLE II

| | | | | | | |
|---|---|---|---|---|---|---|
| Conventional Automatic Knotter/Storage Feeder | 25 | 200 | 150 | 1.7 | 2.90 | 0.0244 |
| Reduced Tension Automatic Yarn Sampler | 25 | 200 | 150 | 1.7 | 2.86 | 0.0245 |

TABLE III

| | | | | | | |
|---|---|---|---|---|---|---|
| Sampled from Sample Spool | 25 | 200 | 150 | 1.7 | 3.46 | 0.0496 |
| Sampled Manually | 25 | 200 | 150 | 1.7 | 3.44 | 0.0452 |

I claim:

1. Apparatus for feeding multifilament yarn thread sequentially from yarn storage bobbins comprising:

(a) means for guiding the position of travel of a moving first yarn thread;

(b) means for holding a stationary second yarn thread and for advancing said second yarn thread into close axial proximity with said first yarn thread within said guide means;

(c) means positioned proximate said guide means for intermeshing the filaments of said second yarn thread with filaments of said first yarn thread;

(d) first yarn cutting means positioned proximate said guide means and on the downstream side of said intermeshing means for severing said stationary second yarn thread from said holding and advancing means;

(e) second yarn cutting means positioned proximate said guide means and on the upstream side of said intermeshing means for severing said moving first yarn thread;

(f) means for coordinating the sequential operation of said holding and advancing means, said first cutting means, said intermeshing means and said second cutting means such that stationary second yarn thread is severed from said holding and advancing means and brought into motion as the result of intermeshing with said moving first yarn thread, and such that said moving first yarn thread is subsequently severed.

2. The apparatus of claim 1 wherein element (c) comprises a housing which contains an air jet which intermeshes the filaments of said second yarn thread and said first yarn thread.

3. The apparatus of claim 1 comprising a deflecting means for deflecting said moving first yarn thread away from said second yarn thread immediately after severing said first yarn thread.

4. The apparatus of claim 3 wherein said deflecting means comprises an air jet.

5. The apparatus of claim 1 wherein said coordinating means is actuated by a pneumatic control system.

6. The apparatus of claim 1 wherein said holding and advancing means comprises a plurality of rotatably mounted feeder wheels having successively matched notches for lacing up a plurality of said second yarn threads before being advanced into operative position.

7. A method of feeding multifilament yarn thread sequentially from yarn storage bobbins comprising:

(a) guiding the position of travel of a moving first yarn thread in a guide means; and (b) holding a stationary second yarn thread; and (c) advancing said second yarn thread into close axial proximity with said first yarn thread within said guide means; and (d) intermeshing said second yarn thread with said first yarn thread; and (e) severing said stationary second yarn thread simultaneously with or preceding said intermeshing step; and (f) severing said moving first yarn thread; and (g) coordinating the sequential advancing, severing of the first yarn thread, intermeshing and severing of the second yarn thread steps such that said stationary second yarn thread is severed and brought into motion as the result of intermeshing with said moving first yarn prior to severing said moving first yarn thread.

8. The method of claim 7 wherein step (e) occurs before step (d).

9. The method of claim 7 wherein step (d) comprises intermeshing said second yarn thread with said first yarn thread by means of an air jet.

10. The method of claim 7 wherein step (e) comprises severing said second yarn thread by means of a blade.

11. The method of claim 7 wherein step (f) comprises severing said first yarn thread by means of a blade.

12. The method of claim 7 wherein step (c) is actuated by means of a pneumatic control system.

13. Automatic yarn sampling device which does not exert significant tension on the multifilament yarn to be sampled comprising (a) a housing with a planar, horizontal surface (b) first means for severance of multifilament yarn, mounted on said planar surface (c) second means for severance of multifilament yarn, mounted on said planar surface (d) means for entanglement of two multifilament yarn threads together, said entanglement means mounted on said planar surface between said first and second severance means, such that a first yarn thread can pass through said first severance means and said entanglement means at speeds of 1,000 meters/minute without significant tension being exerted on said first yarn thread when neither said first severance means or said entanglement means are operating, without said first yarn thread passing through said second yarn severance means, (e) means for storage of a second, stationary multifilament yarn thread mounted on said planar surface, and means for advancing said second yarn thread (f) a first means for guiding said second yarn into (1) said second yarn severance means and (2) said entanglement means, thereby placing said stationary thread and said first yarn thread in close axial proximity to each other (g) a second means for guiding said second yarn into said first severance means (h) means for coordinating the sequential operation of said yarn advancing means, said first severance means, said entanglement means, said second severance means such that said second stationary yarn is severed from said storage means, brought into motion by entanglement with said first yarn thread, and said first yarn thread is subsequently severed.

* * * * *